United States Patent [19]

Celette

[11] Patent Number: 4,916,933

[45] Date of Patent: Apr. 17, 1990

[54] INSTALLATION FOR THE REPAIR AND INSPECTION OF CRASH-DAMAGED VEHICLE BODIES

[75] Inventor: Germain Celette, Vienne, France

[73] Assignee: Celette, S.A., Vienne, France

[21] Appl. No.: 240,827

[22] Filed: Sep. 6, 1988

[30] Foreign Application Priority Data

Sep. 10, 1987 [FR] France ..... 87 12993
Dec. 11, 1987 [JP] Japan ..... 87 17954

[51] Int. Cl.[4] ..... B21D 01/12
[52] U.S. Cl. ..... 72/457; 72/705; 187/8.41
[58] Field of Search ..... 72/705, 457; 187/8.41, 187/8.43, 8.77

[56] References Cited

U.S. PATENT DOCUMENTS 3,111,196 11/1963 Plassman ..... 187/8.41
3,999,419 12/1976 Larson et al. ..... 72/705
4,530,232 7/1985 Smith ..... 72/705

*Primary Examiner*—Lowell A. Larson
*Attorney, Agent, or Firm*—Browdy and Neimark

[57] ABSTRACT

The installation includes a straightening device whose front end is mounted on feet and whose back end is associated with a lift. The back end of the straightening device is equipped with detachable ramps, as well as detachable platforms extending the ramps. On the upper face of the straightening device is mounted longitudinally movable between platforms and the front end, a carriage intended to receive the front axle assembly of the vehicle. The installation is applicable to loading and unloading of the vehicle on a straightening device.

22 Claims, 8 Drawing Sheets

INSTALLATION FOR THE REPAIR AND INSPECTION OF CRASH-DAMAGED VEHICLE BODIES

BACKGROUND OF THE INVENTION

1. Field of the Invention

This invention has as its object an installation for the repair and inspection of crash-damaged vehicle bodies.

2. The Prior Art

It is known, to make repairs of crash-damaged vehicle bodies, to use a straightening device consisting of a rectangular frame obtained from metal sections, with mounting of intermediate braces between the two longitudinal sections. Clamps can be fastened to the straightening device for anchoring the vehicle body to be repaired, as well as crosspieces which receive mountings for positive type repairs and inspection and measuring equipment.

Generally, a straightening device rests on feet or also on wheels allowing its movement inside a shop. However, problems arise which have not yet been solved satisfactorily, when loading a crash-damaged vehicle on the straightening device, and unloading it after repair. These operations are especially delicate as the straightening device is equipped with clamps for fastening the bottom of the body of the vehicle and a vehicle crash-damaged in the front travels with difficulty.

Some installations comprise a rectangular frame equipped, at one of its ends, with a lifting device able to move this end between the floor and a position in which it is at the same height as the other end, the frame being equipped over its entire length with traveling platforms for the vehicle, and two ramps detachably fastened to the vertically movable end. However, these installations have the drawback of not allowing easy loading onto the platforms of a vehicle whose front axle assembly has been damaged. Further, the presence of platforms is bothersome for the operator as well as for mounting of the clamps for fastening the vehicle and the equipment used to straighten it.

SUMMARY OF THE INVENTION

The present invention aims at eliminating these drawbacks.

For this purpose, the installation to which it relates, of the type comprising a straightening device consisting of a frame of general rectangular shape equipped:

close to one of its ends, with stationary support means, such as feet or wheels, and close to its other end with a lifting device able to move this other end vertically between a position in which it rests on the floor and a position in which it is at least at the same height as the first end, two ramps detachably fastened to the end of the vertically movable straightening device, is characterized in that it is further equipped with:

platforms fastened to the upper face of the straightening device in the extension of the ramps and extending from the end of the vertically movable straightening device into a zone not comprising clamps for fastening the vehicle, and a carriage intended to receive the front axle assembly of the vehicle to be repaired, longitudinally movable between a position in which it is located opposite the platforms and a position in which it is located at the other end of the frame.

In practice, to perform loading of a vehicle on a straightening device, it is advisable to proceed as follows: the end of the vertically movable straightening device is placed on the floor and equipped with ramps, the clamps for anchoring the vehicle are removed, and the carriage is placed against the platforms. The vehicle is then moved, automatically if its condition allows, or with a winch until its front axle assembly is on the carriage. The carriage is then moved to the other end of the frame, thus assuring loading of the vehicle on the straightening device.

It is then possible to withdraw the ramps and to actuate the lift to bring the straightening device into working position. Unloading of a vehicle is done by proceeding in the opposite manner.

Advantageously, the platforms, fastened to the frame going from the back end of the latter, are open-worked and the opening that they comprise have such dimensions that they allow the passage of support elements, such as props.

According to an embodiment, each platform consists of a frame equipped with bars crosswise to the axis of the frame.

This arrangement makes it possible, after having brought the end of the vertically movable frame above the working position, to rest support elements such as props on the points of the frame or the suspension close to the back of the vehicle. The lift is then actuated to lower the frame which is separated from the back of the vehicle which rests for its part supported by props. Therefore the operator can, if necessary, remove the back wheels of the vehicle. He can also mount and position precisely the clamps for fastening the vehicle body on the frame. It then suffices to raise the frame until the clamps come to support the body. The props are withdrawn and the platforms, fastened to the frame, can optionally also be withdrawn.

If the front wheels of the vehicle are to be removed, the same procedure is followed with use of props closer to the front of the vehicle.

Preferably, the carriage comprises a rectangular frame of a length at least equal to the maximum track width of the vehicles to be repaired and of a width appreciably less than the diameter of the wheels of the vehicles, equipped with two series of casters resting, respectively, on the upper outside faces of the straightening device, respectively.

In practice, the wheels of the vehicle come to be housed between the two longitudinal sections of the carriage where they are locked because of the weight of the vehicle. The movement of the carriage is then achieved by a manual or electric winch.

According to a variant embodiment of this installation the platforms, fastened to the upper face of the straightening device in the extension of the ramps, consist of a second carriage, intended to receive the back wheels of the vehicle to be repaired, and equipped with locking means, on the one hand, on the end of the straightening device equipped with ramps and, on the other hand, on the first carriage intended to receive the front wheels of the vehicle.

Before loading of the vehicle, the back end of the straightening device is in a low position, the ramps are in place, and the two carriages, contiguous and solidly connected with one another, are fastened to the back end of the straightening device. The vehicle is moved until its front wheels are positioned on the first carriage after having traveled on the second carriage. The first carriage is unlocked from the straightening device and from the second carriage, then moved forward, for example with a winch, carrying the vehicle in this movement. When the back wheels arrive in the second carriage, the latter is unlocked from the straightening device, and the vehicle is then moved on the latter by two carriage until it occupies the desired position. The first carriage is then locked on the straightening device, then the back of the latter is lifted, before placing props ahead of the second carriage, for a sequence of operations described above.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

In any case, the invention will be well understood with the help of the following description, with reference to the accompanying diagrammatic drawing representing by way of nonlimiting examples, several embodiments of this installation, in which.

DETAILED DESCRIPTION OF THE PREFERRED EMBODIMENT

Figure 1:
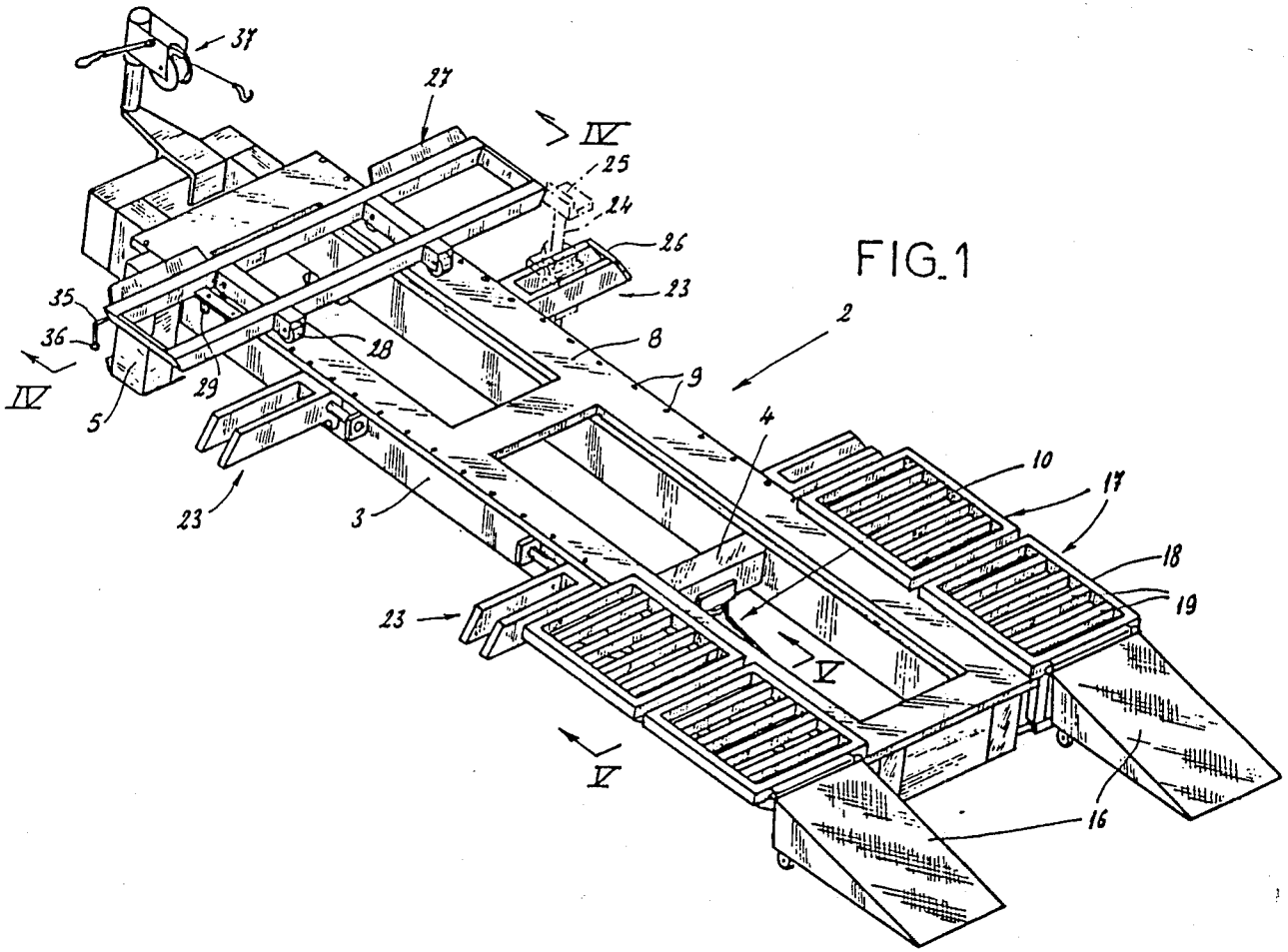
FIG. 1 is a perspective view of a first installation.

The installation, represented in the drawing, comprises a straightening device designated by general reference 2 consisting of a tubular frame 3 of rectangular shape equipped with intermediate crosspieces 4 connecting its longitudinal sections. This straightening device is equipped, close to its front end, with two feet 5 and close to its back end, with two detachable feet mounted to pivot around horizontal pins 7. On its upper face, frame 3 receives, in known way, a ground metal plate 8 comprising holes 9 precisely positioned to receive the measuring and inspection equipment.

Close to its back end, the straightening device is equipped with a lifting device 10 comprising a carriage 12 equipped with casters 13, oriented longitudinally with respect to the straightening device, close to one end of which is mounted, pivoting around a horizontal pin, an arm 14 whose free end is fastened to a crosspiece 4, actuation of a cylinder 15 mounted between the carriage and the arm making it possible to assure a vertical movement of the back end of the straightening device.

The back end of straightening device 2 is equipped, in a detachable way, with two inclined ramps 16 making it possible to bring a vehicle from the floor of the shop to the level of the upper face of the straightening device.

The straightening device is also equipped, in the extension of ramps 16 and going from its back end, with platforms 17, two on each side of the straightening device, in the embodiment shown in FIG. 1.

Figure 5:
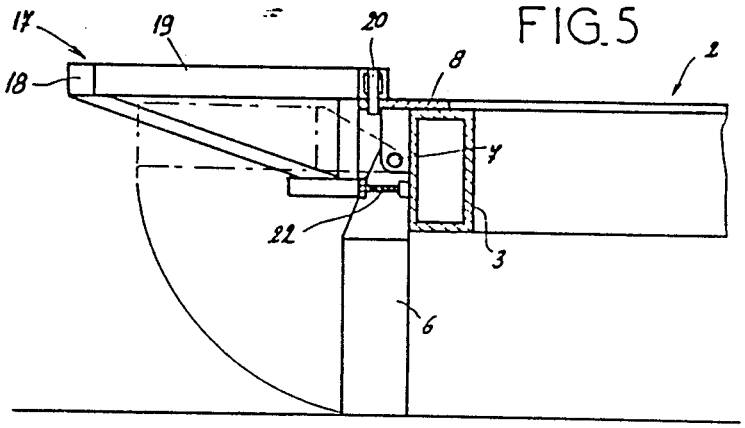
FIG. 5 is a view in cross section of one of the side of the straightening device along line V—V of FIG. 1.

Each platform 17 consists of a tubular frame 18 inside of which are mounted crossbars 19. Mounting of platforms 17 is illustrated in FIG. 5 which shows that each platform 17 comprises pins 20 engaged in holes 9 of the frame, adjustment of the horizontality of each platform being assured by horizontal pins 22 of adjustable length, resting on the outside face of the frame. Therefore it is ease to put the platforms in place and withdraw them.

In front of platforms 17, frame 3 is equipped in a way known in the art, on each of its outside faces, with two longitudinally adjustable supports 23 intended for mounting of threaded rods 24 carrying clamps 25 for fastening the bottom of the frame of the vehicle.

The originality of each support 23 resides in the fact that it consists of a stirrup-shaped part open outward, and which is able to be closed by a plate or pivoting lug means 26, which allows an immediate mounting and dismounting of the unit of bolts 24 and clamps 25, without having to withdraw the nuts for fastening and adjusting the bolt on the support.

According to another characteristic of the invention, the straightening device is equipped with a carriage 27 intended to receive the front axle assembly of the vehicle to be repaired, and able to be moved longitudinally on the upper face of the straightening device between a position in which it is adjacent to platforms 17 and a position in which it is located in the front of the straightening device.

This carriage 27 consists of a rectangular frame, of a length (considered in the direction crosswise to the straightening device) at least equal to the maximum track width of the vehicles to be repaired and of a width appreciably less than the diameter of the wheels of the vehicle, equipped with the series of casters 28, 29 resting on the upper outside faces of the straightening device, respectively.

Figure 6:
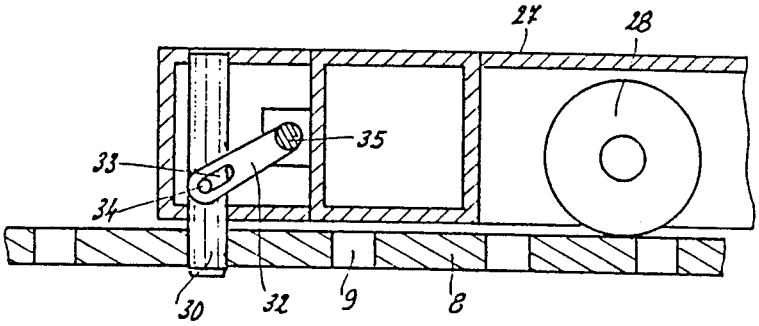
FIG. 6 is a view in section on an enlarged scale of means for locking the carriage on the carriage.

This carriage 27 is equipped with locking means consisting of two locking pins 30 intended to be engaged in two of the holes 9 in straightening device 2 (see FIG. 6). These pins are vertically actuated by two connecting rods 32 each comprising a hole 33 in which is engaged a pin 34 solidly connected with the connecting rod, these connecting rods being locked in rotation on a horizontal pin 35, able to be actuated in rotation by a lever 36.

The front end of the straightening device is detachably equipped with a winch 37 which, in the embodiment represented in the drawing, is manually operated.

The operation of this installation is as follows.

Figure 2:
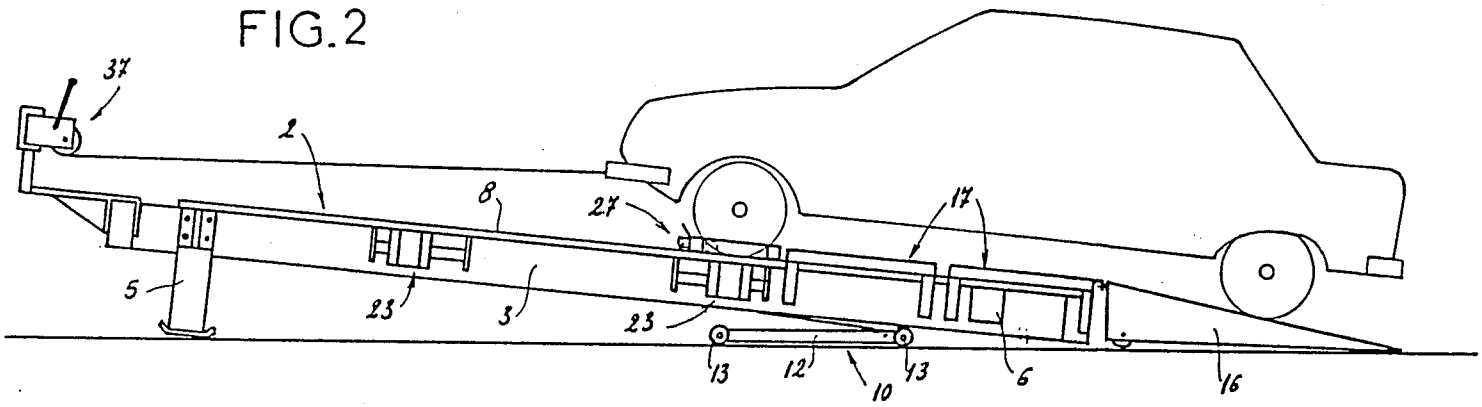
FIGS. 2 and 3 are two side diagrammatic views, respectively, during loading and unloading of a vehicle.

The straightening device being in the position represented in FIG. 2, i.e., lowered back end, carriage 27 against platforms 17 and ramps 16 put in place, the vehicle is moved independently or with winch 37 until its front wheels come to engage in carriage 27, as shown in FIG. 2.

Actuation of the winch is reflected by raising of the vehicle on the straightening device, with movement of carriage 27 towards the front of the latter.

Figure 3:
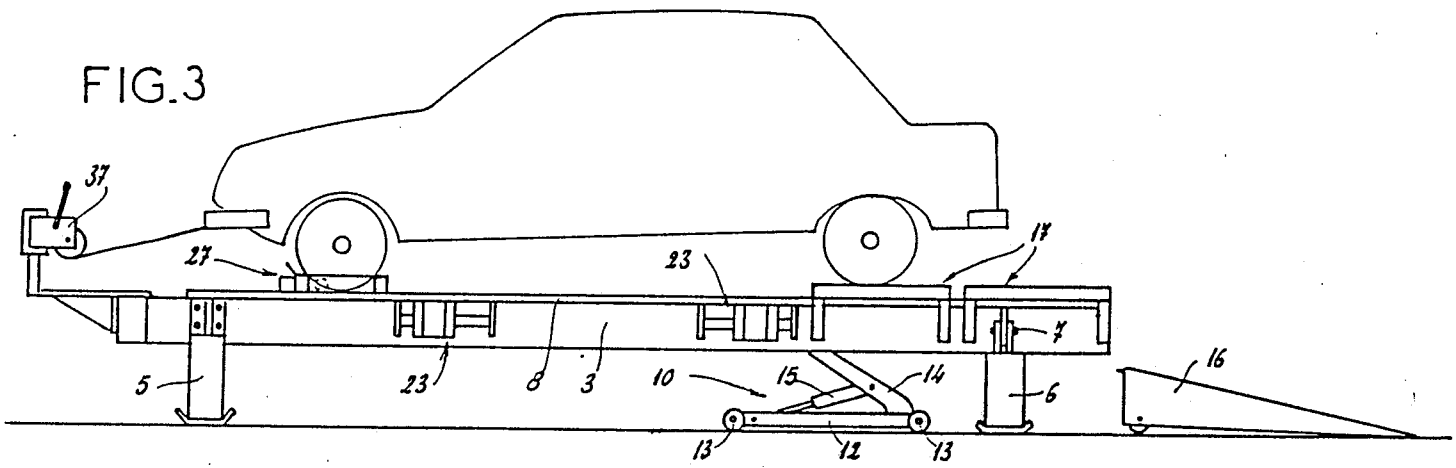
Figure 4:
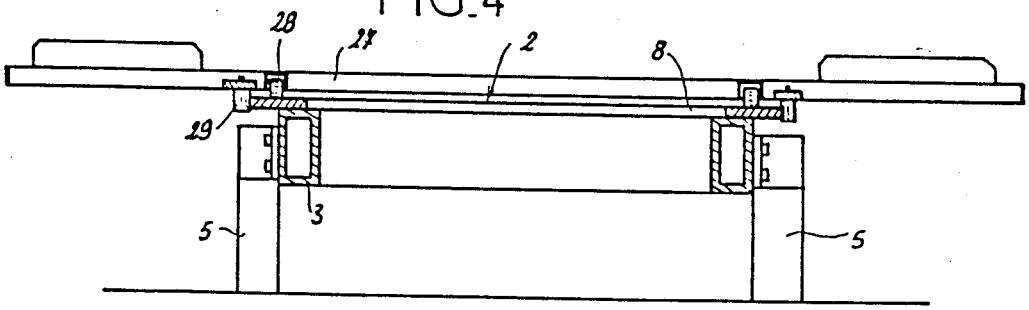
FIG. 4 is a view in cross section of the support carriage of the front axle assembly of the vehicle, along line IV—IV of FIG. 1.

When the vehicle is loaded entirely on the straightening device, carriage 27 is locked in place by pins 30. Actuation of cylinder 15 then makes it possible to lift the back end of the straightening device, a movement during which ramps 16 are separated from the latter (see FIG. 3).

Figure 7:
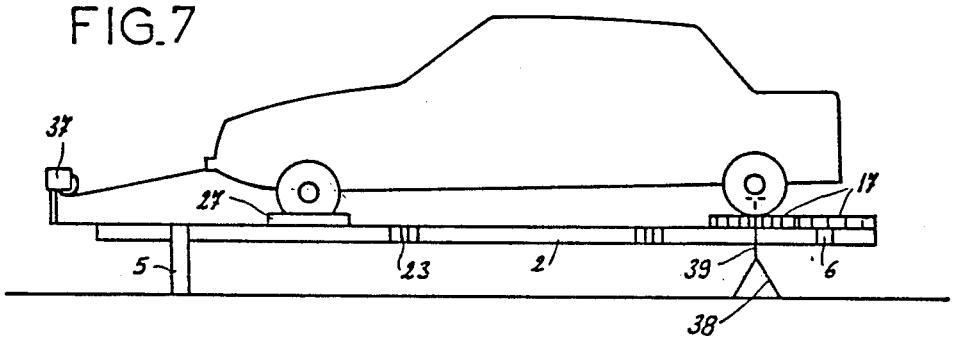
FIGS. 7, 8 and 9 are three very diagrammatic side views corresponding to three operations that a vehicle loaded on straightening device can undergo.

Then it is possible, if necessary, to position a prop 38, so that rod 39 of the latter goes through an opening of a platform 17, and comes to rest under an element located close to the back end of the vehicle, such as an axle shaft, as shown in FIG. 7.

Figure 8:
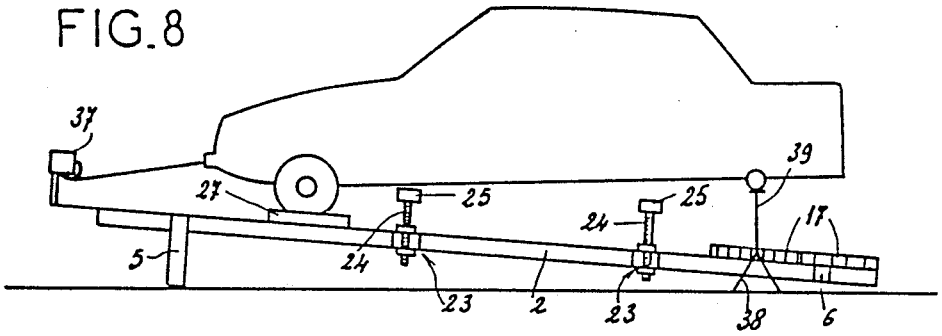
Figure 9:
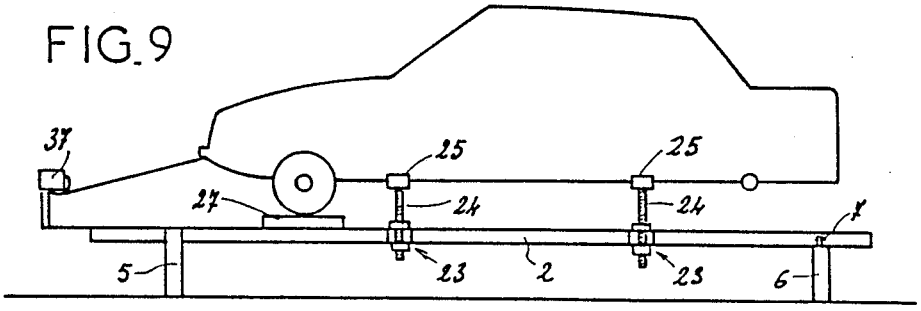

By causing a lowering of the back end of the straightening device, as shown in FIG. 8, a separation is produced between the back wheels and the straightening device and between the vehicle body and the straightening device. The back wheels of the vehicle can be dismounted, and the units of bolts 24-clamps 25 positioned precisely on supports 23, as a function of the type of vehicle to be repaired. A vertical upward movement of the straightening device makes possible, as shown in FIG. 9, taking over of the vehicle by clamps 25. At this moment, it is possible to withdraw props 38 as well as platforms 17, making possible, in this part of the straightening device, the mounting of a traction stirrup to straighten the body in this zone, if necessary.

As shown in FIG. 9, the straightening device rests, in working position, not only on its front feet 35 but also on back feet 36. Unloading of the vehicle is performed by proceeding in the opposite way.

It is also possible, by placing props or other support elements differently, to proceed to dismounting the front wheels after several successive actuations of the straightening device vertically.

Figure 10:
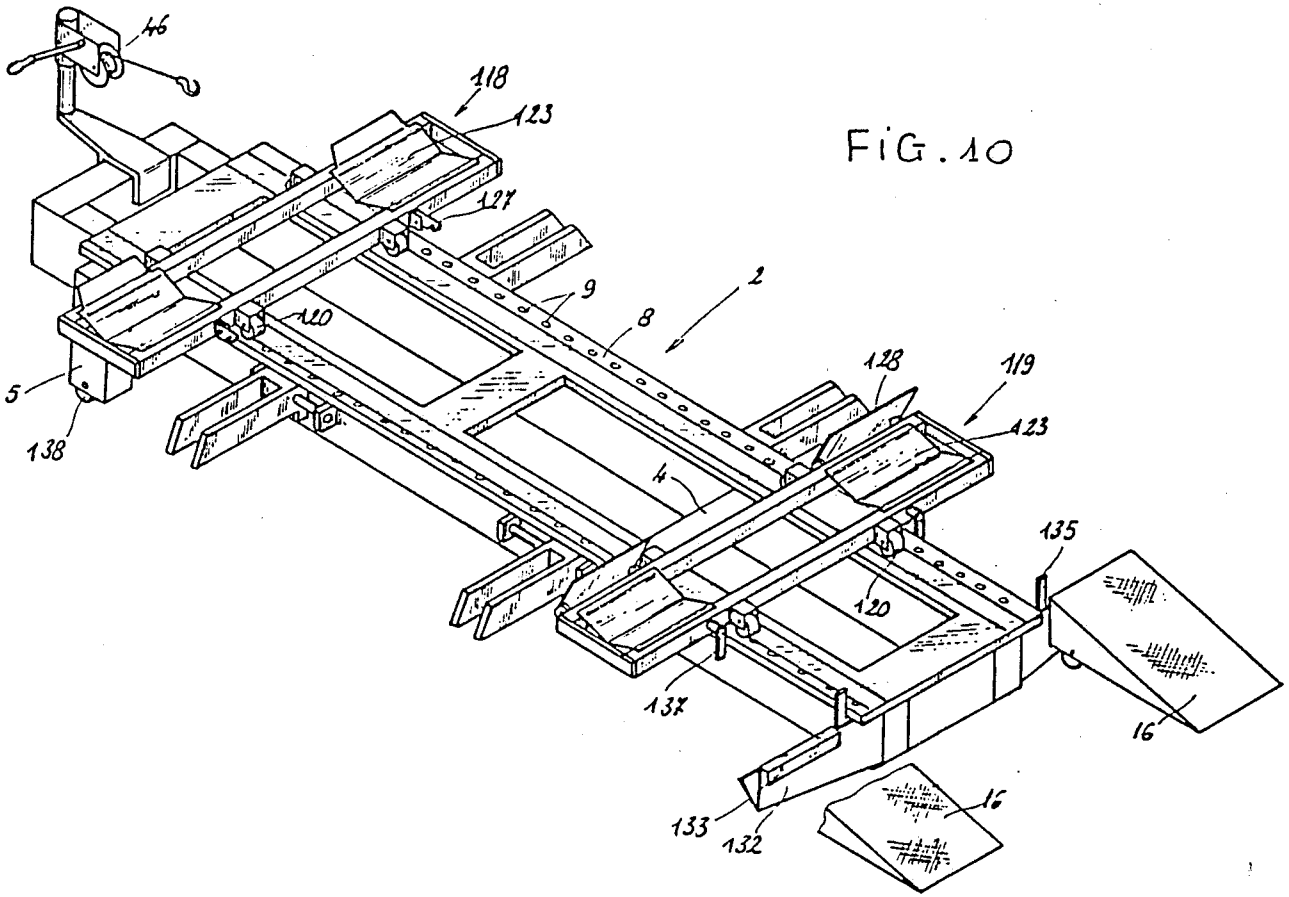
FIG. 10 is a perspective view of a second installation.

The installation represented in FIG. 10 is a variant embodiment of the preceding installation, in which the same elements are designated by the same references as above.

Figure 11:
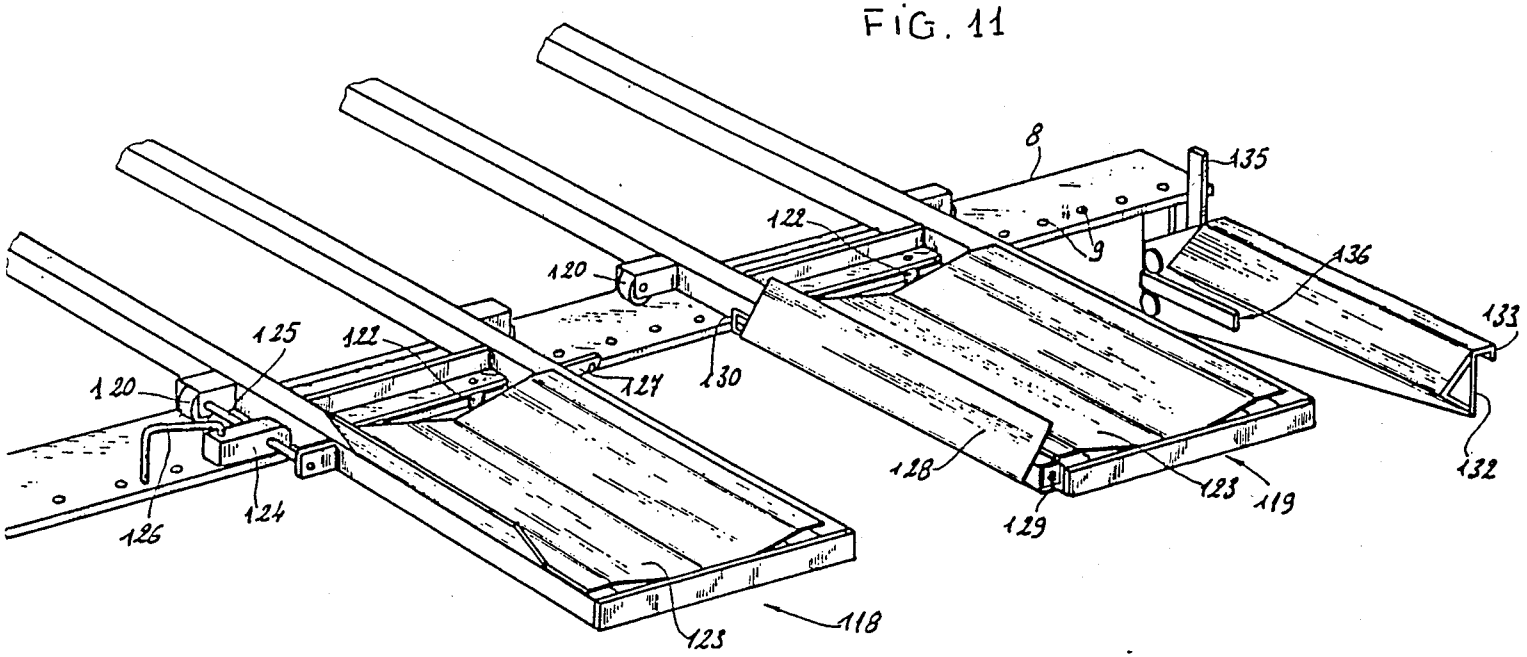
FIG. 11 is a perspective view on enlarged scale of a part of the installation.

The ground metal plates, able to be seen FIGS. 10 and 11, serve for guiding two carriages, namely, a first carriage 118 intended to receive the front wheels of the vehicle and a second carriage 119 intended to receive the back wheels of the vehicle. Each carriage is mounted on the straightening device by several series of rollers, each series comprising a roller 120 with a horizontal axis resting on the upper face of corresponding plate 8, and a roller 122 with a vertical axis resting on the outside lateral face of the same plate.

Figure 15:
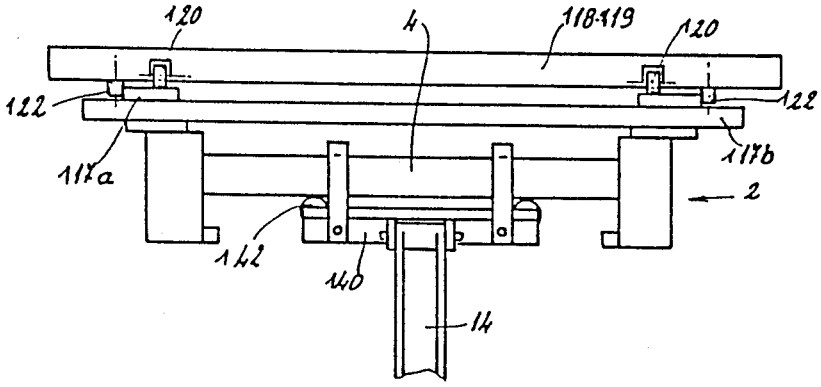
FIGS. 15 and 16 are two very diagrammatic views of the mounting of the lifting device on the back crosspiece of the straightening device.

In a variant, represented in FIG. 15, carriages 118, 119 travel not directly on plates 8 but on bearing races 117*a* fastened to crossbars 117 positioned in orifices 9 of plates 8.

Each of the two carriages 118, 119 is equipped, in the zones that are to receive the wheels of a vehicle, with plates 23 forming a very open V, these plates acting as ramps during loading and unloading operations of the vehicle and wedging the carriage during the movement of the carriage considered on the straightening device.

As shown in FIGS. 10 and 11, carriage 118 is equipped on its front face with two means for locking on the straightening device. Each locking means consists of a metal block 124 mounted to slide on rod 125 oriented crosswise to the straightening device, block 124 also serving for pivoting around a vertical axis of a leg of a part 126 forming a stirrup whose other leg is intended to be engaged in a hole of the straightening device. The combination of the movement of translation of block 124 on rod 125, and of rotation of part 126 always allows an excellent locking to be made of carriage 118 on the straightening device, even if the position of the carriage is not fastened very precisely.

On its back face, carriage 118 is equipped with two hooks 127 pivoted around horizontal pins, intended to achieve hooking of carriage 118 to carriage 119. For this purpose, carriage 119 is equipped, as shown more particularly in FIGS. 10 to 13, With a flap 128 generally shaped like a U whose legs are divergent and able to cover respectively and partially the upper and lower walls of carriage 119. This flap 128 is pivoted by its central part around a pin 129 located on the front face of the carriage and the lower part of the latter. Flap 128 finally exhibits a pin 130 crosswise to the straightening device, intended to work with a hook 127 of carriage 118. The back end of the straightening device is equipped with two sections 132 each of which comprises a lug 133 turned toward the back and downward, intended to engage in a fork 134 fastened to the front face of ramp 16, a lug 135 forming a stop for carriages 118 and 119 so that they cannot escape the straightening device when the latter is in inclined position, and recess 136 forming a latch, inside which a pivoting pin 137 is intended to penetrate to achieve locking of second carriage 119 to the back of the straightening device.

Figure 14:
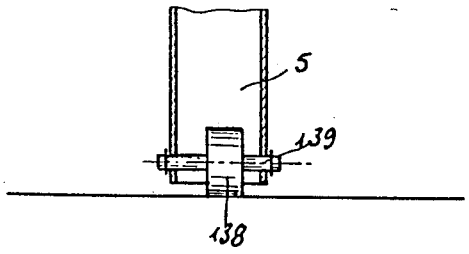
FIG. 14 is a detail views of the lower part of a front foot.

As FIG. 14 shows, each front foot 5 of the straightening device is equipped with a roller 138 mounted on a ball bushing with the possibility of sliding along a pin 139 with orientation to the straightening device. To obtain a latitude of crosswise adjustment of the straightening device, it is also advisable to mount the lift to be detachable crosswise. For this purpose, arm 14 of the lift is in the embodiment represented in FIG. 15, pivoted on the pin of a support 140 mounted with insertion of carrying balls 142 on back crosspiece 4 of the installation.

Figure 16:
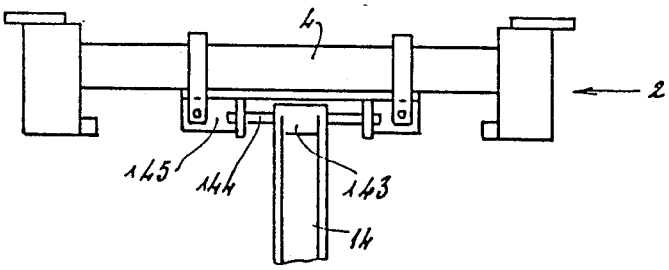

In the embodiment represented in FIG. 16, the upper end of the lifting device is equipped with a bushing 143 for orientation crosswise with respect to the straightening device, engaged on a pin 144 with the same orientation, solidly connected with a fork 145 fastened to the back crosspiece 4 of the straightening device.

Figure 12:
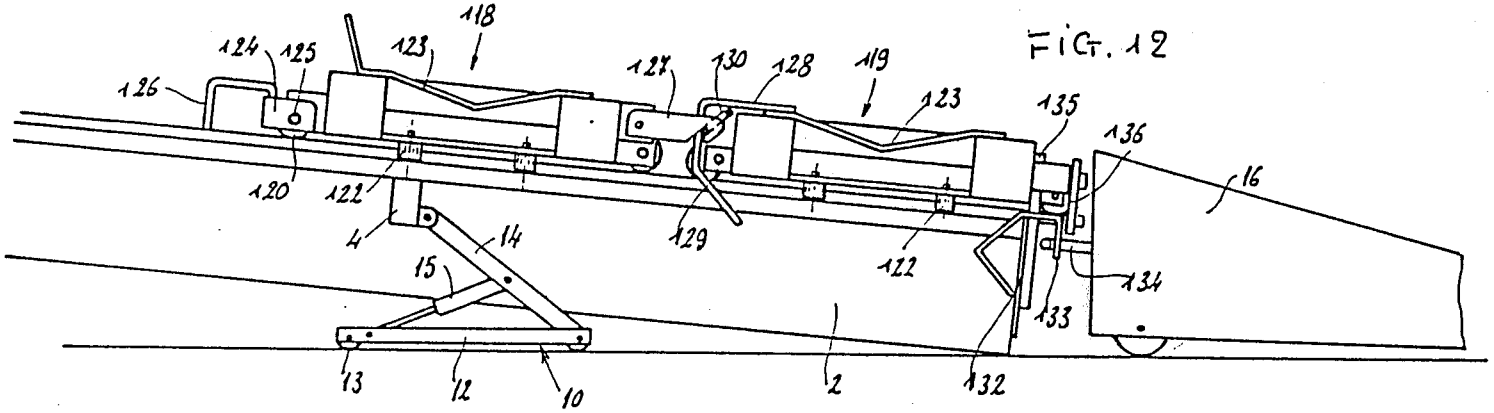
FIGS. 12 and 13 are two side view on an enlarged scale of the back part of the installation in two different positions.
Figure 13:
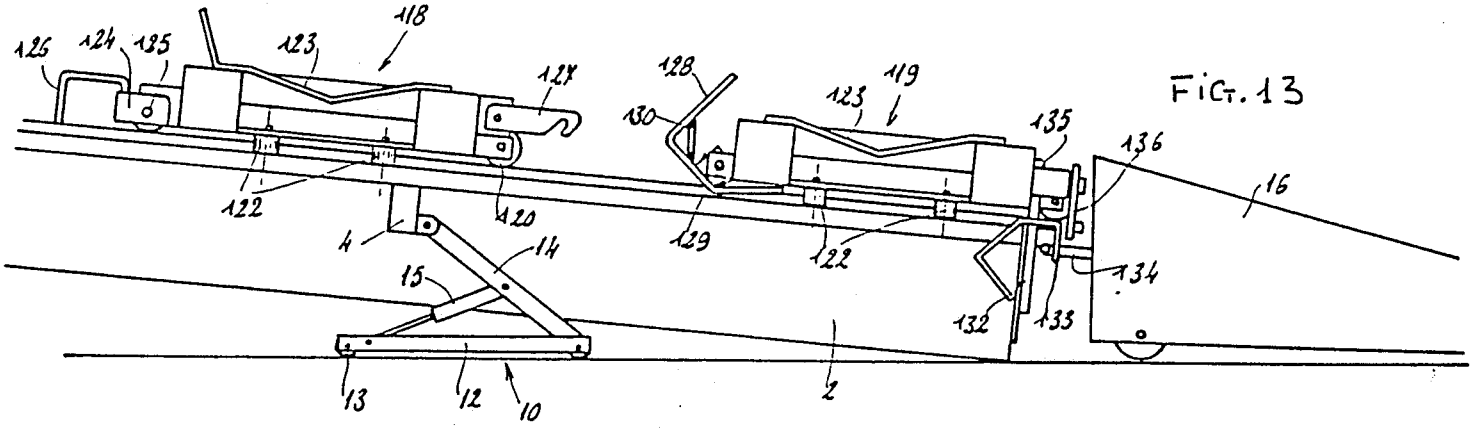

In practice, to achieve loading of a vehicle, the installation is in the position represented in FIG. 12. The back of the straightening device is lowered and equipped with ramps 16, carriage 119 is fastened to the back of the straightening device, and carriage 118 is fastened to carriage 119. When the wheels of the vehicle are positioned on carriage 118, the latter is moved forward, for example with a winch 146. During this movement, hooks 127 exert a traction on pin 130 being reflected by an upward pivoting of flap 128, as shown in FIG. 13, and by separation of the two carriages. When the wheels of the vehicle arrive on back carriage 119, flap 128 acts as a safety stop, and this carriage is unlocked to allow the vehicle to advance to the desired position. The installation is then used in the various ways described above. During unloading of the vehicle, the opposite procedure is followed, hooks 127 assuring the swinging of flaps 128 from the position represented in FIG. 13 to that represented in FIG. 12.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. An installation for repair and inspection of crash-damaged vehicle bodies, including a straightening device consisting of a frame of general rectangular shape, comprising:

stationary support means disposed close to a first end of the device;

a lifting device disposed close to a second end of the device mounted so as to move the second end vertically between a position in which it rests on the floor and a position in which it is at least at the same height as the first end;

two ramps detachably fastened to the second end of the straightening device;

fastening means connected to the frame for fastening the vehicle to be repaired;

platform means fastened to an upper face of the straightening device extending one each from the ramps towards the first end of the vertically movable straightening device; and a first carriage intended to receive the front axle assembly of the vehicle to be repaired, longitudinally movable between a position in which the carriage is located opposite platforms near the second end of the device and a position in which it is located at the first end of the device.

2. The installation according to claim 1, wherein the platform means comprises a plurality of openings having dimensions such that support elements, such as props can be passed therethrough.

3. The installation according to claim 2, wherein said platform means comprises at least two platforms and each platform consists of a frame equipped with bars disposed crosswise to the axis of the frame.

4. The installation according to claim 1, wherein said carriage comprises a rectangular frame of a length at least equal to the maximum track width of the vehicles to be repaired and of a width appreciably less than the diameter of the wheels of the vehicles, equipped with two series of casters resting, respectively, on the upper outside faces the straightening device.

5. The installation according to claim 1, wherein said carriage comprises locking means for locking said carriage to the frame of the straightening device.

6. The installation according to claim 5, wherein said locking means consist of pins sliding vertically in the carriage and intended to engage in holes provided on the straightening device.

7. The installation according to claim 1, wherein said lifting device comprises a carriage mounted on wheels, said carriage comprising an arm pivoted around a horizontal pin at one end thereof having one end connected to an actuating cylinder and another end which can be fastened to a crosspiece of the frame of the straightening device.

8. The installation according to claim 1, wherein said fastening means comprises clamps carried on a threaded rod and each clamp is supported on a support consisting of a part in the shape of a stirrup open outward and whose opening can be closed by pivoting lug means, after engagement of the threaded rod carrying the clamp itself.

9. The installation according to claim 1, wherein the platform means, fastened to the upper face of the straightening device, consists of a second carriage intended to receive the back wheels of the vehicle to be repaired, and equipped with locking means on the second end of the straightening device equipped with ramps and on the first carriage intended to receive the front wheels of the vehicle.

10. The installation according to claim 9, wherein each of the two carriages is equipped, in zones of support of the wheels, with two plates forming a V opened upward and delimiting a depression oriented crosswise to the straightening device, assuring the wedging of the vehicle in a position of support on the carriages.

11. The installation according to claim 10, wherein the second carriage is equipped, at its front end, and opposite each zone of support of a wheel, with a flap mounted to pivot around a horizontal pin which is in a horizontal retracted position when the two carriages are adjacent with one another, and in a vertical position, projecting above the carriage when the two carriages are independent of one another.

12. The installation according to claim 11, wherein each flap has a U-shaped section whose legs are divergent, and come back above and below the carriage, and whose central part is pivoted around the horizontal pin located close to one end of the lower end of the carriage, the central part being equipped with a pin parallel to the horizontal pin behind which a hook is intended to engage pivoted around a horizontal pin on the back edge of the first carriage.

13. The installation according to claim 9, wherein the second carriage is equipped, at its front end, and opposite each zone of support of a wheel, with a flap mounted to pivot around a horizontal pin which is in a horizontal retracted position when the two carriages are adjacent with one another, and in a vertical position, projecting above the carriage when the two carriages are independent of one another.

14. The installation according to claim 13, wherein each flap has a U-shaped section whose legs are divergent, and come back above and below the carriage, and whose central part is pivoted around the horizontal pin located close to one end of the lower end of the carriage, the central part being equipped with a pin parallel to the horizontal pin behind which a hook is intended to engage pivoted around a horizontal pin on the back edge of the first carriage.

15. The installation according to claim 9, wherein the straightening device is equipped at the second end with two sections, each comprising a lug turned toward the back and downward, intended to engage in a fork arranged in the front face of one of the ramps, an upturned lug forming a stop for the second carriage, and a recess forming a latch, inside which a pin is intended to penetrate mounted on the second carriage, when the latter is in retracted position.

16. The installation according to claim 9, wherein the means for locking first carriage to the straightening device consist at the level of each travel zone of the carriage of a metal block mounted to slide on the carriage along a pin crosswise to the straightening device, on which is pivoted around a vertical pin a part in the general shape of a stirrup one of whose legs is intended to engage in the holes made in the straightening device.

17. The installation according to claim 9, wherein each stationary support means disposed at the first end of the straightening device is equipped with a roller mounted by a ball bushing with the possibility of sliding along a pin of orientation crosswise to the straightening device.

18. The installation according to claim 9, wherein an upper end of the lifting device is mounted to pivot around a horizontal axis on a support itself mounted with insertion of carrying balls on a back crosspiece of the straightening device.

19. The installation according to claim 9, wherein an upper end of the lifting device is equipped with a bushing of orientation crosswise to the straightening device, engaged on a pin of the same orientation solid with a fork fastened to a back crosspiece of the straightening device.

20. The installation according to claim 9, wherein the carriages work with bearing races solidly connected with a crosspiece positioned in the holes of the plates of frame.

21. The installation according to claim 1, wherein said stationary support means comprises wheels.

22. The installation according to claim 1, wherein said stationary support means comprises feet.

* * * * *